United States Patent [19]

Von Hagen

[11] Patent Number: 4,779,550

[45] Date of Patent: Oct. 25, 1988

[54] LOOPER DRIVE FOR A CHAINSTITCH SEWING MACHINE

[75] Inventor: Wolf R. Von Hagen, Hemmingen, Fed. Rep. of Germany

[73] Assignee: Union Special G.m.b.H., Stuttgart, Fed. Rep. of Germany

[21] Appl. No.: 91,806

[22] Filed: Aug. 31, 1987

[30] Foreign Application Priority Data

Mar. 19, 1987 [DE] Fed. Rep. of Germany ..... 3709023

[51] Int. Cl.[4] ..... D05B 57/02; D05B 57/06; D05B 71/00

[52] U.S. Cl. ..... 112/199; 112/256

[58] Field of Search ..... 112/162, 197, 199, 256

[56] References Cited

U.S. PATENT DOCUMENTS

| | | | |
|---|---|---|---|
| 3,398,709 | 8/1968 | De Koninck | 112/162 |
| 3,670,677 | 6/1972 | Hirayama | 112/199 |
| 4,543,896 | 10/1985 | De Santis | 112/162 |

FOREIGN PATENT DOCUMENTS

| | | | |
|---|---|---|---|
| 715666 | 2/1980 | U.S.S.R. | 112/199 |

*Primary Examiner*—Wm. Carter Reynolds
*Attorney, Agent, or Firm*—Powell L. Sprunger

[57] ABSTRACT

A looper drive for a chainstitch sewing machine comprising a rigid guide stud which is part of a support member for a looper shaft. The rigid guide stud is surrounded by a bushing which is swivably mounted on the guide stud. The guide stud as well as the bushing are provided with openings through which the looper shaft extends.

6 Claims, 1 Drawing Sheet

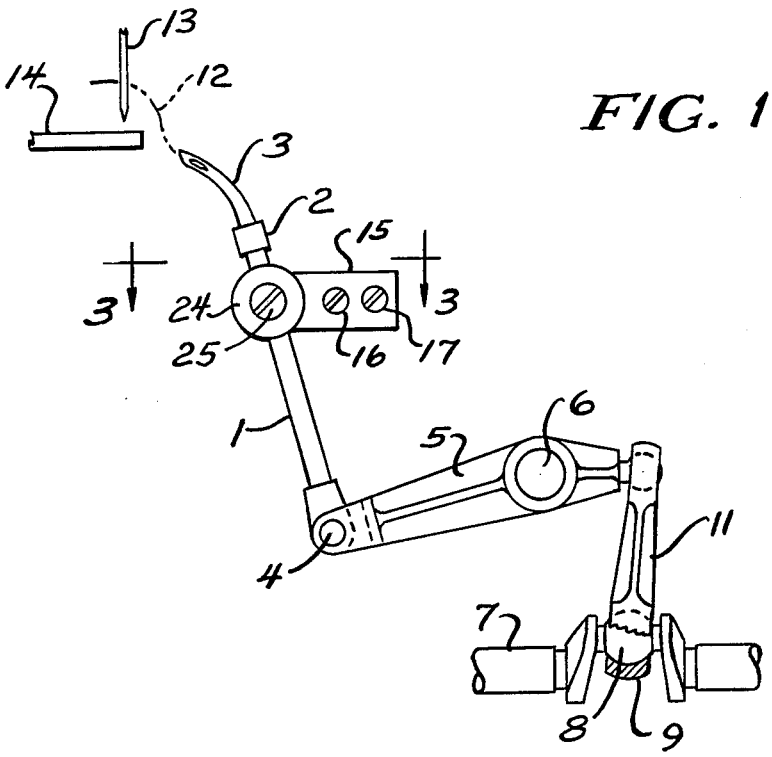
FIG. 1
FIG. 2
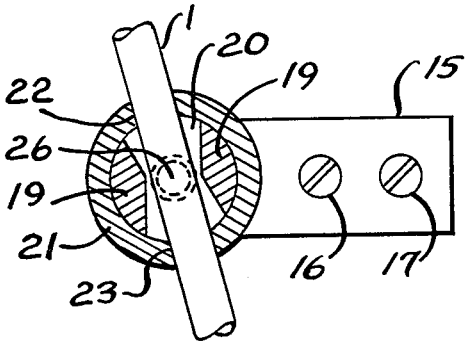
FIG. 3
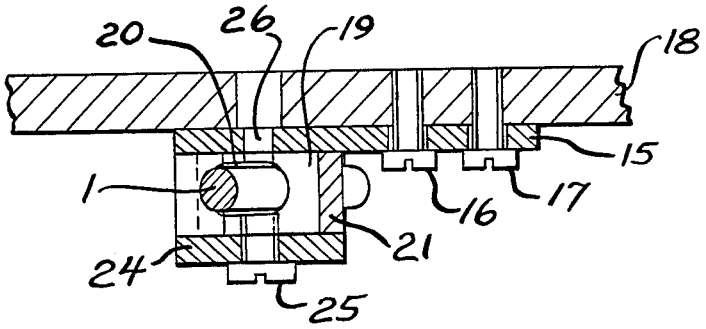

LOOPER DRIVE FOR A CHAINSTITCH SEWING MACHINE

BACKGROUND OF THE INVENTION

The present invention relates to a looper drive for sewing machines, such as chainstitch sewing machines.

A looper drive is known from German patent specification No. 34 43 294. This device used for adjusting the travel of the upper looper in overedging sewing machines incorporates a cylindrical bushing with a diametral hole which carries a rod on which the upper looper is mounted. The cylindrical bushing is snugly received in an opening of a support member which, in turn, has two opposite slots for the looper shaft to pass through. The device according to the afore-mentioned application provides for an upper looper travel adjusting means which allows the axis of the swivel link to move upwards or downwards.

U.S. Pat. No. 3,670,677 relates to a device in which the looper shaft is movably guided in a drum member which, in turh, is snugly received in the opening of a support. The support also has two slots through which the looper shaft extends.

Due to the slots the two aforementioned devices have a disadvantage in that lint built up by the thread and the fabric during the sewing operation accumulates in the slots of the support members.

This prevents lint-free lubrication of the looper shaft bearing means since the lubricating means will blend with the lint producing an abrasive effect which contributes to excessive wear of the looper shaft and its bearing means.

SUMMARY OF THE INVENTION

A principal feature of the present invention is the provision of an improved looper drive for a chain stitch sewing machine.

The looper drive of the present invention comprises, a main shaft, a looper shaft, and means for connecting the looper shaft to the main shaft. The drive has a support member for the looper shaft, with said support member having a rigid guide stud having an opening to receive the looper shaft, and a bushing swivably mounted on the guide stud and having a pair of opposed openings to slidably receive the looper shaft.

A feature of the present invention is that the drive protects the looper shaft and its bearing means against excessive wear.

Another feature of the invention is that the drive provides for proper lubrication of the looper shaft bearing means without lint.

Yet another feature of the invention is that the drive excludes accumulation of lint caused by thread and fabric in a simplified manner.

Further features will become more fully apparent in the following description of the embodiments of this invention and from the appended claims.

DESCRIPTION 0F THE DRAWINGS

In the drawings:

FIG. 1 is a plan view showing a looper drive mechanism according to the present invention;

FIG. 2 is an enlarged partial view, taken partly in section, of the looper drive mechanism; and FIG. 3 is an enlarged cross sectional view taken along line III—III of FIG. 1.

DESCRIPTION 0F THE PREFERRED EMBODIMENTS

The looper drive mechanism as shown in FIG. 1 comprises a looper shaft 1 which at its free end clamps a looper 3 by means of a ring 2 while its other end is swivably mounted to a lever 5 by means of a pin 4. Lever 5 is driven by a main shaft 7 via a ball eccentric 8 which is surrounded by a spherical shell 9, resulting in lever 5 to swing around a shaft 6. The spherical shell 9 is rigidly connected to a connecting rod 11 which, in turn, is coupled to lever 5 by means of a ball bearing. A dotted line 12 illustrates the path of movement of the tip of the looper 3 which crosses the needle 13 above the throat plate 14.

FIG. 2 and 3 are enlarged views of the support member of the looper shaft 1. A carrier 15 is secured to the frame 18 by means of screws 16 and 17. A guide stud 19 is rigidly mounted to carrier 15.

A bushing 21 which encompasses the guide stud 19 with its opening 20 is provided with two openings 22 and 23 in its spherical wall. The two openings 22 and 23 of the bushing 21 as well as the opening 20 of the guide stud 19 accommodate the looper shaft 1. Due to the two openings 22 and 23 spaced to each other the breaking load acting on the looper shaft 1 is considerably reduced as compared to wellknown looper shaft bearing means.

A disc 24 is detachably connected to the guide stud 19 by means of a screw 25 and together with the carrier 15 axially secures the bushing 21. This design allows simple disassembly of the looper shaft bearing means for inspection and for servicing.

A frame 18 is provided with a hole 26 which extends through carrier 15 and partly through guide stud 19 up to the opening 20 of said guide stud. The hole 26 provides for proper lubrication of the looper shaft 1 supplied from the inside of the chainstitch sewing machine.

Due to the arrangement and the oscillating motion of the bushing 21 around the guide stud 19, accumulation of lint caused by thread and fabric during the sewing operation in the area of the looper shaft 1 is excluded. In addition, the breaking load acting of the looper shaft 1 is considerably reduced.

The foregoing detailed description is given for cleaness of understanding only, and no unnecessary limitations should be understood therefrom, as modifications will be obvious to those skilled in the art.

I claim:

1. Looper drive for a chainstitch sewing machine, comprising a main shaft with a ball eccentric, a spherical shell surrounding the eccentric, a connecting rod flexibly connected to a swing arm as well as a looper shaft swingably and movably bearinged in a support member, said support member incorporating a rigid guide stud encompassed by a bushing which is swivably mounted on the guide stud whereby the guide stud as well as the bushing have openings which accommodate the looper shaft whereby the looper shaft is slidably supported in the two openings located in the spherical wall of the bushing.

2. Looper drive according to claim 1, wherein the bushing is axially guided by means of a disc which is detachably connected to the guide stud.

3. Looper drive according to claim 1, wherein the guide stud is provided with a lubricating hole which extends into the opening that accommodates the looper shaft.

4. A looper drive for a chainstitch sewing machine comprising:

a main shaft;

a looper shaft;

means for connecting the looper shaft to the main shaft;

a support member for the looper shaft, with said support member having a rigid guide stud having an opening to receive the looper shaft, and a bushing swivably mounted on the guide stud and having a pair of opposed openings to slidably receive the looper shaft.

5. The looper drive of claim 4 wherein the bushing is axially guided by a disc detachably connected to the guide stud.

6. The looper drive of claim 4 wherein the guide stud has a lubricating hole extending into the opening of the guide stud.

* * * * *